US012674626B2

(12) United States Patent
Chen et al.

(10) Patent No.: US 12,674,626 B2
(45) Date of Patent: Jul. 7, 2026

(54) LOOP HEAT PIPE ONE-WAY CIRCULATION DEVICE

(71) Applicant: Auras Technology Co., Ltd., New Taipei City (TW)

(72) Inventors: Chih-Wei Chen, New Taipei City (TW); Kang-Ming Fan, New Taipei City (TW)

(73) Assignee: Auras Technology Co., Ltd., New Taipei City (TW)

( * ) Notice: Subject to any disclaimer, the term of this patent is extended or adjusted under 35 U.S.C. 154(b) by 97 days.

(21) Appl. No.: 18/647,494

(22) Filed: Apr. 26, 2024

(65) Prior Publication Data

US 2024/0361083 A1 Oct. 31, 2024

Related U.S. Application Data

(60) Provisional application No. 63/462,108, filed on Apr. 26, 2023.

(30) Foreign Application Priority Data

Nov. 28, 2023 (TW) ..... 112146008

(51) Int. Cl.
*F28D 15/02* (2006.01)

(52) U.S. Cl.
CPC ..... *F28D 15/0266* (2013.01); *F28D 15/0275* (2013.01)

(58) Field of Classification Search
CPC ..... F28D 15/0266; F28D 15/0275
See application file for complete search history.

(56) References Cited

U.S. PATENT DOCUMENTS 5,859,763 A * 1/1999 Nam ..... H01L 23/473 257/E23.098
5,998,863 A * 12/1999 Kobayashi ..... F28F 3/12 361/699
8,016,024 B2 * 9/2011 Kang ..... F28D 15/043 165/104.21
10,096,537 B1 * 10/2018 Chen ..... F28D 15/0266
2004/0250994 A1 * 12/2004 Chordia ..... F28D 15/0266 257/E23.098
2006/0065385 A1 * 3/2006 Tonosaki ..... F28D 15/043 165/104.21
2006/0096742 A1 * 5/2006 Bhatti ..... H01L 23/473 257/E23.098
2006/0157227 A1 * 7/2006 Choi ..... H01L 23/427 165/104.21

(Continued)

*Primary Examiner* — Travis Ruby
(74) *Attorney, Agent, or Firm* — MUNCY, GEISSLER, OLDS & LOWE, P.C.

(57) ABSTRACT

A loop heat pipe one-way circulation device includes a lower cover plate and an upper casing closely connected to the lower cover plate. The upper casing includes a fluid inlet, a fluid outlet, a joint surface, a heat absorption area and a gas discharge cavity. The joint surface is in close contact with the lower cover plate, and the heat absorption area is formed between the fluid inlet and the fluid outlet. In addition, the heat absorption area includes a heat absorption area inner surface height, and the gas discharge cavity has a gas discharge cavity height, and the gas discharge cavity height is greater than the heat absorption area inner surface height.

11 Claims, 3 Drawing Sheets

(56) References Cited

U.S. PATENT DOCUMENTS

| | | | | |
|---|---|---|---|---|
| 2007/0034358 | A1* | 2/2007 | Lee | H01L 23/427 165/104.21 |
| 2014/0190669 | A1* | 7/2014 | Hoshino | H01L 23/473 165/104.19 |
| 2014/0246176 | A1* | 9/2014 | Yang | F28D 15/0266 165/104.26 |
| 2018/0031328 | A1* | 2/2018 | Cheng | F28F 9/026 |
| 2019/0178583 | A1* | 6/2019 | Chen | F28D 21/00 |
| 2019/0204014 | A1* | 7/2019 | Yoshinori | F28D 15/06 |
| 2020/0011610 | A1* | 1/2020 | Wang | F28F 9/0263 |
| 2020/0173731 | A1* | 6/2020 | Kawabata | F28D 15/04 |
| 2020/0400379 | A1* | 12/2020 | Watanabe | H05K 7/20336 |
| 2023/0288147 | A1* | 9/2023 | Enright | F28D 15/0266 |
| 2024/0044582 | A1* | 2/2024 | Mu | F28F 3/12 |

* cited by examiner

LOOP HEAT PIPE ONE-WAY CIRCULATION DEVICE

RELATED APPLICATIONS

This application claims priority to U.S. Provisional Application Ser. No. 63/462,108, filed Apr. 26, 2023, and Taiwan Application Serial Number 112146008, filed Nov. 28, 2023, the disclosures of which are incorporated herein by reference in their entireties.

TECHNICAL FIELD

The present disclosure relates to a one-way circulation device. More particularly, the present disclosure relates to a loop heat pipe one-way circulation device.

BACKGROUND

With the increasing computing capability of processors, temperature control of electronic components such as processors is becoming more and more important. When the computing speed of the working chip (i.e., the heat source) in the electronic devices such as mobile phones, tablets, and notebook computers, continues to increase, the ambient temperature of the system also increases, but the system stability may therefore reduce.

In order to solve the foregoing problem, the heat pipes and vapor chambers are adopted to dissipate heat generated by the working chip, so that the heat of the working chip may be quickly discharged from the system of the electronic devices such as mobile phones, tablets and laptop computers to control the temperature within the system so as to maintain the system stability.

Generally, the vapor chamber and the heat pipe may be connected to the heat source that needs to dissipate heat, and connected to the heat sink fins or other heat dissipation devices, so as to transfer the heat to the heat sink fins or other heat dissipation devices using the vapor chamber plate or heat pipe so as to take the heat out of the electronic devices such as mobile phones, tablets, and laptops, thereby improving the working reliability of the electronic components.

In addition, the loop heat pipes have functions such as high heat transfer, long-distance heat transport and low thermal resistance so as to widely utilize in the aerospace technology field, the energy field and the electronic component cooling field. However, because of the advancement of science and technology, there is still a need to improve the performance of the loop heat pipes.

SUMMARY

The summary of the present invention is intended to provide a simplified description of the disclosure to enable readers to have a basic understanding of the disclosure. The summary of the present invention is not a complete overview of the disclosure, and it is not intended to point out the importance of the embodiments/key elements of the present invention or define the scope of the invention.

One objective of the embodiments of the present invention is to provide a loop heat pipe one-way circulation device to improve the heat dissipation efficiency of the loop heat pipe one-way circulation device.

To achieve these and other advantages and in accordance with the objective of the embodiments of the present invention, as the embodiment broadly describes herein, the embodiments of the present invention provides a loop heat pipe one-way circulation device including a lower cover plate and an upper casing in close contact with the lower cover plate. The upper casing includes a fluid inlet, a fluid outlet, a joint surface, a heat absorption area, and a gas discharge cavity. The joint surface is in close contact with the lower cover plate, and the heat absorption area is formed between the fluid inlet and the fluid outlet. In addition, the heat absorption area includes a heat absorption area inner surface height, the gas discharge cavity has a gas discharge cavity height, and the gas discharge cavity height is greater than the heat absorption area inner surface height.

In some embodiments, the upper casing further includes a fluid guiding block, and the fluid guiding block includes a tip toward a direction of the fluid outlet.

In some embodiments, the upper casing further includes an inlet flow channel having an inlet flow channel upper surface height, and the heat absorption area inner surface height is greater than the inlet flow channel upper surface height.

In some embodiments, the upper casing further includes a gas storage chamber having a gas storage chamber height, and the gas storage chamber height is greater than the heat absorption area inner surface height.

In some embodiments, at least part of the inlet flow channel is located between the heat absorption area and the gas storage chamber.

In some embodiments, the inlet flow channel, the heat absorption area, the gas storage chamber and the gas discharge cavity surround the fluid guiding block.

In some embodiments, the fluid guiding block is attached on the lower cover plate.

In some embodiments, a gas storage chamber active section is formed between the inlet flow channel and the gas storage chamber to control whether a heat dissipation gas follows from the heat absorption area into the gas storage chamber.

In some embodiments, the heat absorption area further includes a plurality of heat conducting protrusions downwardly extending from the heat absorption area.

In some embodiments, the upper casing further includes a fluid inlet chamber located at the fluid inlet, the fluid inlet chamber includes a fluid inlet chamber height, and the fluid inlet chamber height is higher than the inlet flow channel upper surface height.

In some embodiments, the upper casing further includes a fluid isolation bump located between the fluid inlet chamber and the gas storage chamber.

In some embodiments, the fluid outlet is approximately flushed with a gas discharge cavity upper surface of the gas discharge cavity.

In some embodiments, the gas storage chamber height is equal to the gas discharge cavity height.

Hence, the loop heat pipe one-way circulation device disclosed in the present disclosure may utilize the gas storage chamber and the fluid guiding block to increase the gas discharge pressure, prevent the gas from flowing back and increase the heat dissipation efficiency. In addition, the loop heat pipe one-way circulation device disclosed in the present disclosure may utilize the gas storage chamber active section to open or close the gas storage chamber according to the actual needs to further increase the working efficiency of the loop heat pipe one-way circulation device and the heat dissipation efficiency of the loop heat pipe.

BRIEF DESCRIPTION OF THE DRAWINGS

The disclosure can be more fully understood by reading the following detailed description of the embodiment, with reference made to the accompanying drawings as follows.

DETAILED DESCRIPTION OF THE PREFERRED EMBODIMENT

Figure 1:
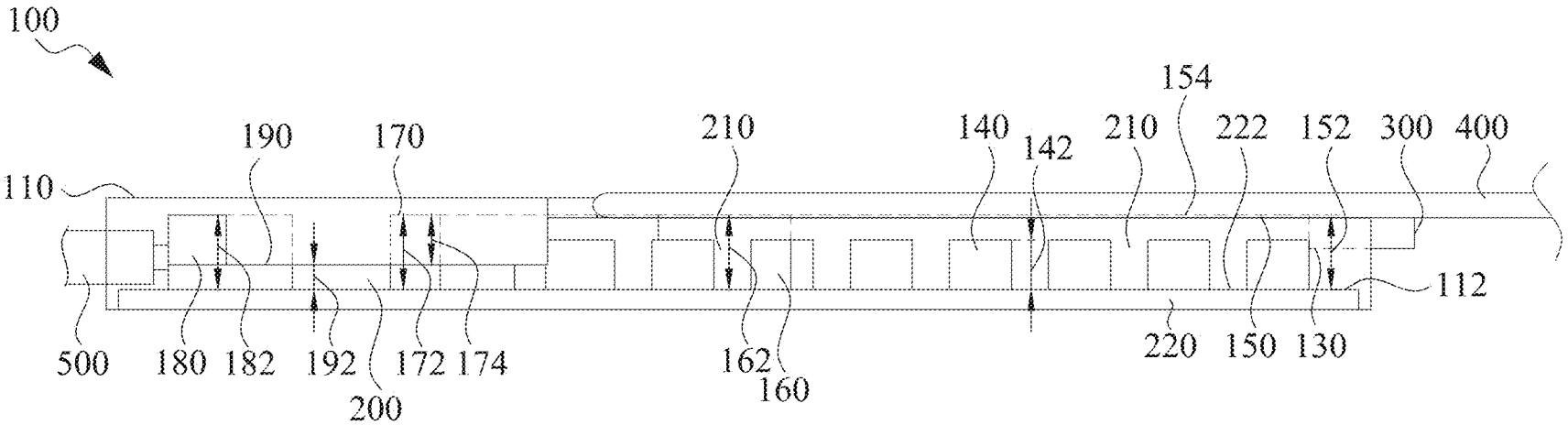
FIG. 1 illustrates a schematic side view of a loop heat pipe one-way circulation device according to one embodiment of the present invention.

The following is a detailed description of the embodiments in conjunction with the accompanying drawings, but the provided embodiments are not intended to limit the scope of the disclosure, and the description of the structure and operation is not used to limit the execution sequence thereof. The structure of the recombination of components and the resulting devices with equal functions are all within the scope of this disclosure. In addition, the drawings are for illustration purposes only, and are not drawn according to the original scale. For ease of understanding, the same reference numbers are used in the drawings and the description to refer to the same or like parts.

In addition, the terms used in the entire description and the scope of the patent application, unless otherwise specified, usually have the usual meaning of each term used in this field, in the content disclosed here and in the special content. Some terms used to describe the disclosure are discussed below or elsewhere in this specification to provide additional guidance to those skilled in the art in the disclosure.

In the implementation mode and the scope of the present application, unless the article is specifically limited in the context, "a" and "the" can generally refer to a single or pluralities. In the steps, the numbering is only used to conveniently describe the steps, rather than to limit the sequence and implementation.

Secondly, the words "comprising", "including", "having", "containing" and the like used in the present application are all open language, meaning including but not limited to.

Figure 2:
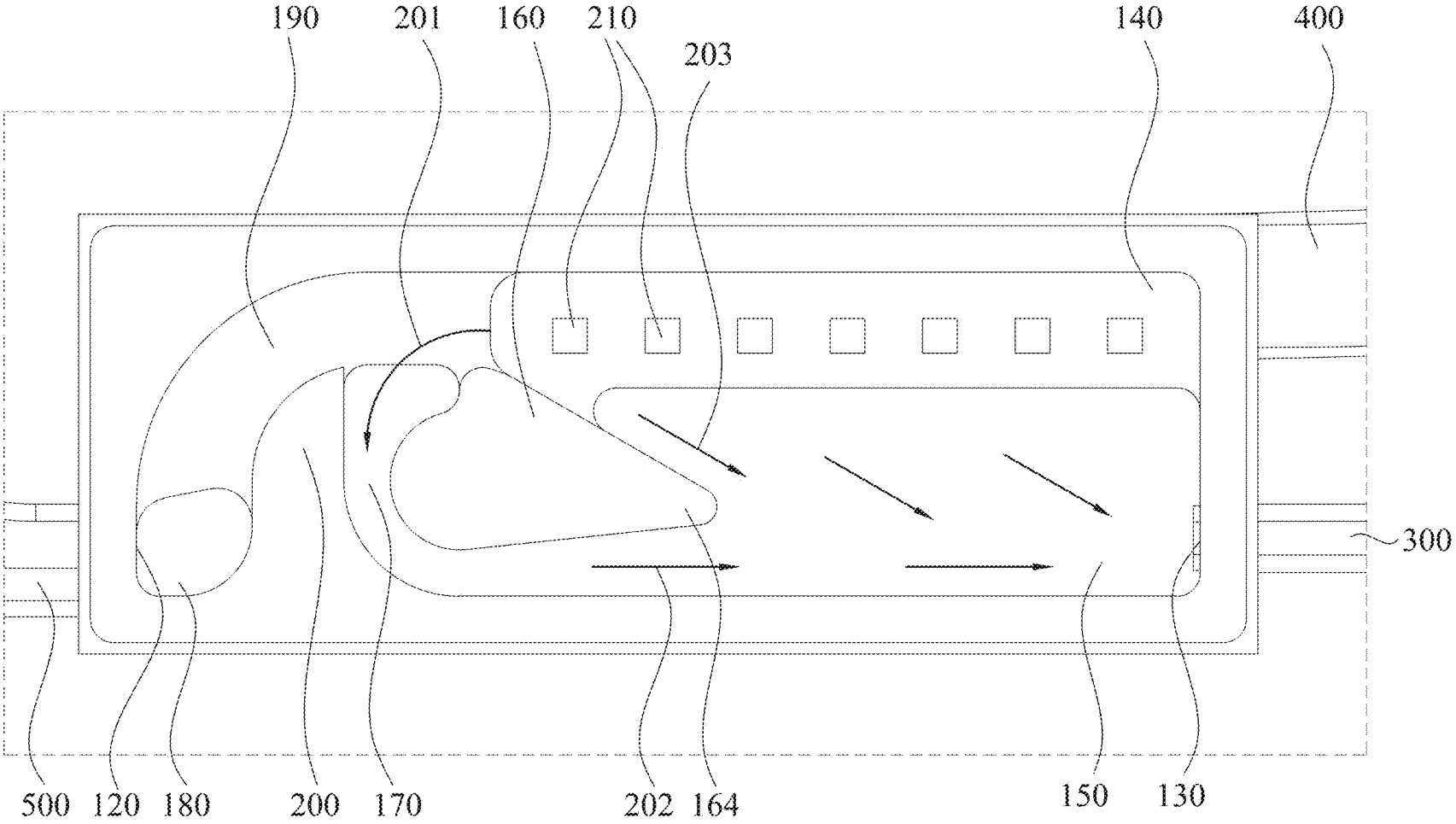
FIG. 2 illustrates a schematic bottom view of the loop heat pipe one-way circulation device of FIG. 1.
Figure 3:
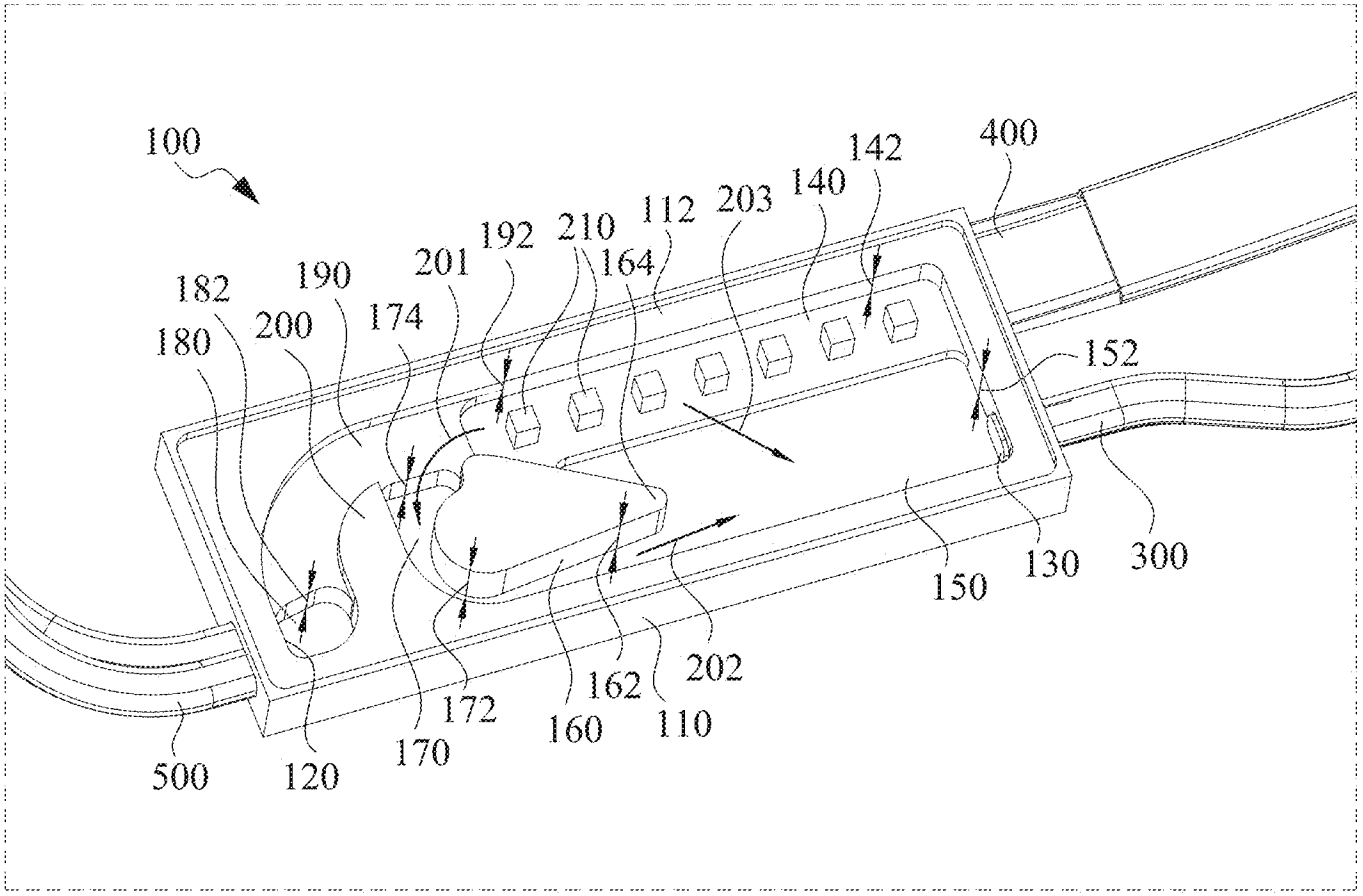
FIG. 3 illustrates a schematic perspective bottom diagram of the loop heat pipe one-way circulation device of FIG. 1.

FIG. 1 illustrates a schematic side view of a loop heat pipe one-way circulation device according to one embodiment of the present invention, FIG. 2 illustrates a schematic bottom view thereof and FIG. 3 illustrates a schematic perspective bottom diagram thereof.

Simultaneously referring to FIGS. 1-3, the loop heat pipe one-way circulation device 100 includes an upper casing 110 and a lower cover plate 220. A heat source 400 is, for example, a processor of an electronic device or a heat pipe connected to the processor, but not limited thereto. The heat source 400 is connected to the upper casing 110 to dissipate the heat of the electronic components.

In some embodiments, the upper casing 110 includes a fluid inlet 120, a fluid outlet 130, a joint surface 112, a heat absorption area 140 and a gas discharge cavity 150.

In addition, the lower cover plate 220 includes a lower cover plate upper surface 222 and at least part of the lower cover plate upper surface 222 is in close contact with the joint surface 112 of the upper casing 110. The heat absorption area 140 is formed between the fluid inlet 120 and the fluid outlet 130, and the heat absorption area 140 includes a heat absorption area inner surface height 142. In addition, the gas discharge cavity 150 includes a gas discharge cavity height 152, and the gas discharge cavity height 152 is greater than the heat absorption area inner surface height 142. Therefore, when the heat absorption area 140 absorbs the heat from the heat source 400 and the heat dissipation fluid vaporizes into the heat dissipation gas, the heat dissipation gas may flow to the fluid outlet 130 through the gas discharge cavity 150 and then enter the loop heat pipe for subsequent cooling through the gas outlet pipe 300 connected to the fluid outlet 130. The cooled heat dissipation fluid may re-enter the loop heat pipe one-way circulation device 100 through the fluid inlet 120 by way of the fluid inlet pipeline 500 of the loop heat pipe to dissipate the heat of the electronic components. It is worth noting that, the upper casing 110 of the loop heat pipe one-way circulation device 100 further includes a fluid guiding block 160, for example, a fluid guiding block 160 including a heart-shaped cross-section, and therefore, the fluid guiding block 160 includes a tip 164, referring to FIG. 2. The tip 164 is disposed toward the direction of the fluid outlet 130 to collect the heat dissipation fluid flowing through the second gas flow channel 202 and the third gas flow channel 203 on both sides of the tip 164 and accelerates the heat dissipation fluid flowing toward the fluid outlet 130, and the heat dissipation fluid enters the loop heat pipe through the gas outlet pipe 300.

In some embodiments, the loop heat pipe one-way circulation device 100 further includes a gas storage chamber 170 having a gas storage chamber height 172, and the gas storage chamber height 172 is greater than a heat absorption area inner surface height 142. Therefore, the gas storage chamber 170 may also store the heat dissipation gas vaporized by the heat dissipation fluid heated in the heat absorption area 140 and guide the heat dissipation gas to the fluid outlet 130 by way of the first gas flow channel 201 and the second gas flow channel 202, and then the heat dissipation gas enters the loop heat pipe through the gas outlet pipe 300.

In addition, because the gas storage chamber 170 is more close to the heat source 400, the temperature and pressure of the heat dissipation gas in the gas storage chamber 170 are higher than the temperature and pressure of the heat dissipation gas in the gas discharge cavity 150. Therefore, the pressure of the heat dissipation gas discharged from the first gas flow channel 201 and the second gas flow channel 202 is higher so as to assist in pushing the heat dissipation gas in the gas discharge cavity 150 toward the fluid outlet 130 at the same time, prevent the heat dissipation gas in the loop heat pipe one-way circulation device 100 from flowing back and increase the heat dissipation efficiency of the loop heat pipe one-way circulation device 100.

In some embodiments, the loop heat pipe one-way circulation device 100 further includes an inlet flow channel 190 having an inlet flow channel upper surface height 192, and the heat absorption area inner surface height 142 is greater than the inlet flow channel upper surface height 192.

It is worth noting that, at least part of the inlet flow channel 190 is located between the heat absorption area 140 and the gas storage chamber 170. Therefore, a gas storage chamber active section 174 is formed between the inlet flow channel 190 and the gas storage chamber 170 to control whether the heat dissipation gas follows from the heat absorption area 140 into the gas storage chamber 170.

In some embodiments, when the liquid height of the heat dissipation fluid is greater than the inlet flow channel upper surface height 192, that is to say, the upper surface of the liquid is locates between the gas storage chamber active section 174, the inlet flow channel 190 may filled with the liquid so that the heat dissipation gas in the heat absorption area 140 may directly flow to the fluid outlet 130 through the third gas flow channel 203 and enter the loop heat pipe through the gas outlet pipe 300.

In some embodiments, when the liquid height of the heat dissipation fluid is lower than the inlet flow channel upper surface height 192, that is to say, the upper surface of the liquid is lower than the gas storage chamber active section 174. Because the gas storage chamber height 172 is higher than the inlet flow channel upper surface height 192, the heat dissipation gas flowing from the heat absorption area 140 to the inlet flow channel 190 may preferably flow to the gas storage chamber 170 having a higher rooftop to prevent the heat dissipation gas from flowing back to the fluid inlet 120 through the inlet flow channel 190. As shown in FIG. 2, the heat dissipation gas may flow to the gas storage chamber 170 through the first gas flow channel 201 from the heat absorption area 140, and stores in the gas storage chamber 170 so as to increase the temperature and pressure of the heat dissipation gas. In addition, the heat dissipation gas is discharged from the second gas flow channel 202 and may push the heat dissipation gas in the gas discharge cavity 150 toward the fluid outlet 130 so as to prevent the heat dissipation gas in the loop heat pipe one-way circulation device 100 from flowing back and further increase the heat dissipation efficiency of the loop heat pipe one-way circulation device 100.

In some embodiments, the inlet flow channel 190, the heat absorption area 140, the gas storage chamber 170 and the gas discharge cavity 150 surround the periphery of the fluid guiding block 160.

In some embodiments, the first gas flow channel 201, the second gas flow channel 202 and the third gas flow channel 203 surround the periphery of the fluid guiding block 160.

In some embodiments, the fluid guiding block 160 is attached on the lower cover plate 220. Therefore, the fluid guiding block height 162 of the fluid guiding block 160 is equal to the gas discharge cavity height 152, that is, equal to a height from the gas discharge cavity upper surface 154 to the lower cover plate upper surface 222.

In some embodiments, the gas storage chamber height 172, the fluid guiding block height 162 and the gas discharge cavity height 152 may be equal to each other.

In some embodiments, the heat absorption area 140 further includes a plurality of heat conducting protrusions 210 downwardly extending from the heat absorption area 140, and preferably the heat conducting protrusions 210 are attached on the lower cover plate 220.

In some embodiments, the upper casing 110 of the loop heat pipe one-way circulation device 100 further includes a fluid inlet chamber 180 located at the fluid inlet 120, the fluid inlet chamber 180 includes a fluid inlet chamber height 182, and the fluid inlet chamber height 182 is higher than the inlet flow channel upper surface height 192.

In some embodiments, the upper casing 110 of the loop heat pipe one-way circulation device 100 further includes a fluid isolation bump 200 located between the fluid inlet chamber 180 and the gas storage chamber 170 to separate the heat dissipation fluid in the fluid inlet chamber 180 and the heat dissipation fluid in the gas storage chamber 170.

In some embodiments, the fluid outlet 130 is preferably flushed with the gas discharge cavity upper surface 154 of the gas discharge cavity 150 to increase the efficiency of the gas discharge.

Accordingly, the loop heat pipe one-way circulation device disclosed in the present disclosure may utilize the gas storage chamber and the fluid guiding block to increase the gas discharge pressure, prevent the gas from flowing back and increase the heat dissipation efficiency. In addition, the loop heat pipe one-way circulation device disclosed in the present disclosure may utilize the gas storage chamber active section to open or close the gas storage chamber according to the actual needs to further increase the working efficiency of the loop heat pipe one-way circulation device and the heat dissipation efficiency of the loop heat pipe.

Although the present disclosure has been disclosed above in terms of implementation, it is not intended to limit the present disclosure. Any person with ordinary knowledge in the field may make various variations and modifications without departing from the spirit and scope of the disclosure. Therefore, the spirit and scope of the appended claims should not be limited to the description of the embodiments contained herein.

What is claimed is:

1. A loop heat pipe one-way circulation device, comprising:

a lower cover plate; and an upper casing in close contact with the lower cover plate, wherein the upper casing comprises:

a fluid inlet;

a fluid outlet;

a joint surface in close contact with the lower cover plate;

a heat absorption area formed between the fluid inlet and the fluid outlet, wherein the heat absorption area comprises a heat absorption area inner surface height; and a gas discharge cavity having a gas discharge cavity height, wherein the gas discharge cavity height is greater than the heat absorption area inner surface height, wherein the upper casing further comprises a fluid guiding block, and the fluid guiding block comprises a tip toward a direction of the fluid outlet, wherein the fluid guiding block extends downward from the upper casing and is attached on the lower cover plate.

2. The loop heat pipe one-way circulation device of claim 1, wherein the upper casing further comprises an inlet flow channel having an inlet flow channel upper surface height, and the heat absorption area inner surface height is greater than the inlet flow channel upper surface height.

3. The loop heat pipe one-way circulation device of claim 2, wherein the upper casing further comprises a gas storage chamber having a gas storage chamber height, and the gas storage chamber height is greater than the heat absorption area inner surface height.

4. The loop heat pipe one-way circulation device of claim 3, wherein at least a part of the inlet flow channel is located between the heat absorption area and the gas storage chamber.

5. The loop heat pipe one-way circulation device of claim 4, wherein the inlet flow channel, the heat absorption area, the gas storage chamber and the gas discharge cavity surround the fluid guiding block.

6. The loop heat pipe one-way circulation device of claim 5, wherein a gas storage chamber active section is formed between the inlet flow channel and the gas storage chamber to control whether a heat dissipation gas follows from the heat absorption area into the gas storage chamber.

7. The loop heat pipe one-way circulation device of claim 3, wherein the upper casing further comprises a fluid inlet chamber located at the fluid inlet, the fluid inlet chamber comprises a fluid inlet chamber height, and the fluid inlet chamber height is higher than the inlet flow channel upper surface height.

8. The loop heat pipe one-way circulation device of claim 7, wherein the upper casing further comprises a fluid isolation bump located between the fluid inlet chamber and the gas storage chamber.

9. The loop heat pipe one-way circulation device of claim 3, wherein the gas storage chamber height is equal to the gas discharge cavity height.

10. The loop heat pipe one-way circulation device of claim 1, wherein the heat absorption area further comprises a plurality of heat conducting protrusions downwardly extending from the heat absorption area.

11. The loop heat pipe one-way circulation device of claim 1, wherein the fluid outlet is approximately flushed with a gas discharge cavity upper surface of the gas discharge cavity.

* * * * *